US009744757B1

(12) United States Patent
Stowe et al.

(10) Patent No.: US 9,744,757 B1
(45) Date of Patent: Aug. 29, 2017

(54) METHODS FOR REJUVENATING AN IMAGING MEMBER OF AN INK-BASED DIGITAL PRINTING SYSTEM

(71) Applicant: XEROX CORPORATION, Norwalk, CT (US)

(72) Inventors: Timothy D. Stowe, Alameda, CA (US); Gregory B. Anderson, Emerald Hills, CA (US); Santokh S. Badesha, Pittsford, NY (US); Mandakini Kanungo, Penfield, NY (US)

(73) Assignees: XEROX CORPORATION, Norwalk, CT (US); PALO ALTO RESEARCH CENTER INCORPORATED, Palo Alto, CA (US)

( * ) Notice: Subject to any disclaimer, the term of this patent is extended or adjusted under 35 U.S.C. 154(b) by 0 days.

(21) Appl. No.: 15/240,691

(22) Filed: Aug. 18, 2016

(51) Int. Cl.
*B41F 7/26* (2006.01)
*G03G 15/20* (2006.01)

(52) U.S. Cl.
CPC ..... *B41F 7/26* (2013.01); *G03G 15/2057* (2013.01)

(58) Field of Classification Search
CPC ..... B41F 2/26
USPC ..... 101/450.1
See application file for complete search history.

(56) References Cited

U.S. PATENT DOCUMENTS 3,945,957 A 3/1976 Noshiro et al.
4,304,601 A 12/1981 Sharp
4,403,550 A 9/1983 Sharp
4,445,432 A 5/1984 Ford, Jr. et al.
4,711,818 A * 12/1987 Henry ..... C08L 83/08 428/421
4,806,391 A 2/1989 Shorin
(Continued)

FOREIGN PATENT DOCUMENTS

EP 1235863 B1 1/2005
JP 03069954 A 8/1989
(Continued)

OTHER PUBLICATIONS

Badesha, et al. "Fluorosilicone composite and Formulation Process for Imaging Plate", U.S. Appl. No. 15/222,364, filed Jul. 28, 2016 (Provide copy).

(Continued)

*Primary Examiner* — Blake A Tankersley
*Assistant Examiner* — Michael Robinson
(74) *Attorney, Agent, or Firm* — MH2 Technology Law Group LLP

(57) ABSTRACT

Disclosed herein are methods for an ink-based digital printing system, comprising providing an imaging member a reimageable surface layer disposed on a structural mounting layer, the reimageable surface layer comprising a fluorosilicone elastomer and an infrared-absorbing filler comprising carbon black, and a plurality of surface defects on the reimageable surface layer, wherein the surface defects comprises carbon black exposed through the fluorosilicone elastomer of the reimageable surface layer. The method also comprises applying a coating of rejuvenating oil comprising an amino-functional organopolysiloxane to the reimageable surface layer, whereby at least a portion of the plurality of surface defects are coated by the amino-functional organopolysiloxane, thereby rejuvenating the imaging member.

8 Claims, 3 Drawing Sheets

(56) References Cited

U.S. PATENT DOCUMENTS

| | | | |
|---|---|---|---|
| 4,911,999 | A | 3/1990 | Legere |
| 4,927,180 | A | 5/1990 | Trundle et al. |
| 5,085,698 | A | 2/1992 | Ma et al. |
| 5,502,476 | A | 3/1996 | Neal et al. |
| 5,834,118 | A | 11/1998 | Ranby et al. |
| 5,886,067 | A | 3/1999 | Li et al. |
| 5,977,202 | A | 11/1999 | Chawla et al. |
| 6,114,489 | A | 9/2000 | Vicari et al. |
| 6,329,446 | B1 | 12/2001 | Sacripante et al. |
| 6,348,561 | B1 | 2/2002 | Mychajlowskij et al. |
| 6,664,015 | B1 | 12/2003 | Sacripante et al. |
| 6,896,937 | B2 | 5/2005 | Woudenberg |
| 7,022,752 | B2 | 4/2006 | Hayashi et al. |
| 7,151,153 | B2 | 12/2006 | Bruchmann et al. |
| 7,202,006 | B2 | 4/2007 | Chopra et al. |
| 7,208,258 | B2 | 4/2007 | Gervasi et al. |
| 7,322,688 | B2 | 1/2008 | Woudenberg |
| 7,538,070 | B2 | 5/2009 | Iftime et al. |
| 7,556,844 | B2 | 7/2009 | Iftime et al. |
| 7,674,326 | B2 | 3/2010 | Iftime et al. |
| 7,708,396 | B2 | 5/2010 | Iftime et al. |
| 7,718,325 | B2 | 5/2010 | Norsten et al. |
| 7,723,398 | B2 | 5/2010 | Ilg et al. |
| 7,909,924 | B2 | 3/2011 | Krishnan et al. |
| 7,964,271 | B2 | 6/2011 | Norsten et al. |
| 8,001,889 | B2 | 8/2011 | Gaugenrieder et al. |
| 8,124,791 | B2 | 2/2012 | Shinjo et al. |
| 8,158,693 | B2 | 4/2012 | Breton et al. |
| 8,222,313 | B2 | 7/2012 | Iftime et al. |
| 8,771,787 | B2 | 7/2014 | Breton et al. |
| 8,895,400 | B2 | 11/2014 | Seo et al. |
| 8,934,823 | B1 * | 1/2015 | Pickering ..... G03G 15/2025 399/325 |
| 9,011,594 | B1 | 4/2015 | Kanungo et al. |
| 9,193,209 | B2 | 11/2015 | Dooley et al. |
| 9,283,795 | B1 | 3/2016 | Kanungo et al. |
| 9,359,512 | B2 | 6/2016 | Moorlag et al. |
| 9,387,661 | B2 | 7/2016 | Zirilli |
| 9,422,436 | B2 | 8/2016 | Birau et al. |
| 2002/0040073 | A1 | 4/2002 | Stone et al. |
| 2002/0107303 | A1 | 8/2002 | Miyabashi et al. |
| 2003/0003323 | A1 | 1/2003 | Murakami et al. |
| 2003/0021961 | A1 | 1/2003 | Ylitalo et al. |
| 2003/0044691 | A1 | 3/2003 | Setthachayanon et al. |
| 2003/0073762 | A1 | 4/2003 | Jung et al. |
| 2003/0149130 | A1 | 8/2003 | Kondo |
| 2004/0063809 | A1 | 4/2004 | Fu et al. |
| 2004/0132862 | A1 | 7/2004 | Woudenberg |
| 2004/0233465 | A1 | 11/2004 | Coyle et al. |
| 2005/0166783 | A1 | 8/2005 | Ylitalo et al. |
| 2006/0054040 | A1 | 3/2006 | Daems et al. |
| 2006/0110611 | A1 * | 5/2006 | Badesha ..... C09D 183/08 428/447 |
| 2007/0073762 | A1 | 3/2007 | Adamson et al. |
| 2007/0166479 | A1 | 7/2007 | Drake et al. |
| 2007/0259986 | A1 | 11/2007 | Elwakil et al. |
| 2008/0090929 | A1 | 4/2008 | Wilson et al. |
| 2008/0139743 | A1 | 6/2008 | Krishnan et al. |
| 2008/0241485 | A1 | 10/2008 | Shimohara et al. |
| 2008/0258345 | A1 | 10/2008 | Bens et al. |
| 2008/0317957 | A1 | 12/2008 | Overbeek et al. |
| 2009/0038506 | A1 | 2/2009 | Odell et al. |
| 2009/0104373 | A1 | 4/2009 | Vanbesien et al. |
| 2009/0110843 | A1 | 4/2009 | Halahmi et al. |
| 2009/0135239 | A1 | 5/2009 | Chretien et al. |
| 2009/0280302 | A1 | 11/2009 | Fukumoto et al. |
| 2010/0020123 | A1 | 1/2010 | Hirato |
| 2010/0067056 | A1 | 3/2010 | Rich et al. |
| 2010/0214373 | A1 | 8/2010 | Carr et al. |
| 2010/0239777 | A1 | 9/2010 | Nakajima et al. |
| 2011/0045199 | A1 | 2/2011 | Cong |
| 2011/0141187 | A1 | 6/2011 | Takabayashi |
| 2011/0188023 | A1 | 8/2011 | Rondon et al. |
| 2011/0196058 | A1 | 8/2011 | Breton et al. |
| 2011/0262711 | A1 | 10/2011 | Chopra et al. |
| 2012/0040156 | A1 | 2/2012 | Ohashi et al. |
| 2012/0103212 | A1 | 5/2012 | Stowe et al. |
| 2012/0103213 | A1 | 5/2012 | Stowe et al. |
| 2012/0103218 | A1 | 5/2012 | Stowe et al. |
| 2012/0103221 | A1 | 5/2012 | Stowe et al. |
| 2012/0157561 | A1 | 6/2012 | Gould et al. |
| 2013/0050366 | A1 | 2/2013 | Sasada et al. |
| 2013/0104756 | A1 | 5/2013 | Stowe et al. |
| 2013/0305946 | A1 | 11/2013 | Iftime et al. |
| 2013/0305947 | A1 | 11/2013 | Iftime et al. |
| 2013/0307913 | A1 | 11/2013 | Kawashima et al. |
| 2013/0310479 | A1 | 11/2013 | Lee et al. |
| 2013/0310517 | A1 | 11/2013 | Lee et al. |
| 2013/0324653 | A1 | 12/2013 | Bollard et al. |
| 2014/0235752 | A1 | 8/2014 | Gharapetian et al. |
| 2014/0333704 | A1 | 11/2014 | Takabayashi et al. |
| 2014/0340455 | A1 | 11/2014 | Breton et al. |
| 2015/0077501 | A1 | 3/2015 | Breton et al. |
| 2015/0093690 | A1 | 4/2015 | Shimura et al. |
| 2015/0170498 | A1 | 6/2015 | Beggs et al. |
| 2015/0174887 | A1 | 6/2015 | Moorlag et al. |
| 2015/0175820 | A1 | 6/2015 | Breton et al. |
| 2015/0175821 | A1 | 6/2015 | Moorlag et al. |
| 2016/0090490 | A1 | 3/2016 | Moorlag et al. |
| 2016/0176185 | A1 | 6/2016 | Kanungo et al. |
| 2016/0177113 | A1 | 6/2016 | Allen et al. |
| 2016/0222231 | A1 | 8/2016 | Allen et al. |
| 2016/0230027 | A1 | 8/2016 | Birau et al. |
| 2016/0237290 | A1 | 8/2016 | Moorlag et al. |
| 2016/0257829 | A1 | 9/2016 | Breton et al. |
| 2016/0264798 | A1 | 9/2016 | Allen et al. |
| 2016/0333205 | A1 | 11/2016 | Lee et al. |

FOREIGN PATENT DOCUMENTS

| | | | |
|---|---|---|---|
| JP | 2011208019 | A | 10/2011 |
| WO | WO2013119539 | A1 | 8/2013 |

OTHER PUBLICATIONS

Communication dated May 4, 2015, issued in EP Appl. No. 14196839.6, pp. 1-5.

Henri Bouas-Laurent, et al., Organic Photochromism (IUPAC Technical Report), Pure Appl. Chem., vol. 73, No. 4, pp. 639-665, 2001.

Leach, et al., "The Printing Ink Manual, 5th Edition", Blue Print, New York, pp. 84-86, 516, 525, 544-550, 724-726 (1993).

Thesis of Enrique Michel-Sanchez, Impact of Particle Morphology on the Rheology of PCC-Based Coatings, Aug. 2005.

Birau, et al. "Ink Composition and Method of Printing", U.S. Appl. No. 15/377,881, filed Dec. 13, 2016.

Allen, et al., "Acrylate Ink Compositions for Ink-Based Digital Lithographic Printing", U.S. Appl. No. 15/435,098, filed Feb. 16, 2017.

Breton, et al. "Aqueous Dispersible Polymer Inks", U.S. Appl. No. 15/442,260, filed Feb. 24, 2017.

* cited by examiner

METHODS FOR REJUVENATING AN IMAGING MEMBER OF AN INK-BASED DIGITAL PRINTING SYSTEM

FIELD OF DISCLOSURE

The disclosure relates to ink-based digital printing systems and methods. In particularly to methods for rejuvenating an imaging member of an ink-based digital printing system.

BACKGROUND

Typical lithographic and offset printing techniques utilize plates which are permanently patterned, and are therefore useful only when printing a large number of copies of the same image (i.e. long print runs), such as magazines, newspapers, and the like. However, they do not permit creating and printing a new pattern from one page to the next without removing and replacing the print cylinder and/or the imaging plate (i.e., the technique cannot accommodate true high speed variable data printing wherein the image changes from impression to impression, for example, as in the case of digital printing systems). Furthermore, the cost of the permanently patterned imaging plates or cylinders is amortized over the number of copies. The cost per printed copy is therefore higher for shorter print runs of the same image than for longer print runs of the same image, as opposed to prints from digital printing systems.

Accordingly, a lithographic technique, referred to as variable data lithography, has been developed which uses an imaging member comprising a non-patterned reimageable surface that is initially uniformly coated with a dampening fluid layer. Regions of the dampening fluid are removed by exposure to a focused radiation source (e.g., a laser light source) to form pockets. A temporary pattern in the dampening fluid is thereby formed over the non-patterned reimageable surface. Ink applied thereover is retained in the pockets formed by the removal of the dampening fluid. The inked surface is then brought into contact with a substrate, and the ink transfers from the pockets in the dampening fluid layer to the substrate. The dampening fluid may then be removed, a new uniform layer of dampening fluid applied to the reimageable surface, and the process repeated.

The imaging member comprises a low surface energy coating of fluorosilicone comprising infrared-absorbing fillers such as carbon black. However, over time, mechanical stresses due to repeated contact of the imaging member with the printed surfaces results in wearing off of the fluorosilicone coating. Such wear leads to exposed carbon black on the surface of the fluorosilicone coating, thereby creating high surface energy point defects, which causes background imaging defects and shorter imaging member life.

Accordingly, there is a need to develop methodologies for the rejuvenation of the imaging member for variable data lithography.

SUMMARY

The following presents a simplified summary in order to provide a basic understanding of some aspects of one or more embodiments of the present teachings. This summary is not an extensive overview, nor is it intended to identify key or critical elements of the present teachings, nor to delineate the scope of the disclosure. Rather, its primary purpose is merely to present one or more concepts in simplified form as a prelude to the detailed description presented later.

Additional goals and advantages will become more evident in the description of the figures, the detailed description of the disclosure, and the claims.

The foregoing and/or other aspects and utilities embodied in the present disclosure may be achieved by providing a method for an ink-based digital printing system comprising:

i. providing an imaging member comprising:
   a. a reimageable surface layer disposed on a structural mounting layer, the reimageable surface layer comprising a fluorosilicone elastomer and an infrared-absorbing filler comprising carbon black, and
   b. a plurality of surface defects on the reimageable surface layer, wherein the surface defects comprises carbon black exposed through the fluorosilicone elastomer; and ii. applying a coating of rejuvenating oil comprising an amino-functional organopolysiloxane to the reimageable surface layer, whereby at least a portion of the plurality of surface defects are coated by the amino-functional organopolysiloxane, thereby rejuvenating the imaging member.

In an embodiment, the amino-functional organopolysiloxane has the following Formula:

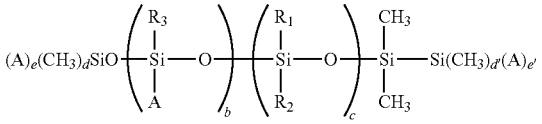

wherein i. A represents —$R_4$—X;

ii. X represents —$NH_2$ or —$NHR_5NH_2$;

iii. $R_4$ and $R_5$ are the same or different and each is an alkyl having from 1 to 10 carbons;

iv. $R_1$ and $R_2$ are the same or different and each is an alkyl having from 1 to 25 carbons, an aryl having from 4 to 10 carbons, or an arylalkyl;

v. $R_3$ is an alkyl having from 1 to 25 carbons, an aryl having from about 4 to about 10 carbons, an arylalkyl, or a substituted diorganosiloxane chain having from 1 to 500 siloxane units;

vi. b and c are numbers and are the same or different and each satisfy the conditions of $0 \le b \le 10$ and $10 \le c \le 1{,}000$; and vii. d and d' are numbers and are the same or different and are 2 or 3, and e and e' are numbers and are the same or different and are 0 or 1 and satisfy the conditions that $d+e=3$ and $d'+e'=3$, and viii. b, e, and e' must not all be 0 at the same time.

In another embodiment, the amino-functional organopolysiloxane comprises an amino-functional group present in an amount of from 0.01 to 0.7 mol % amine.

In yet another embodiment, the amino-functional organopolysiloxane comprises an alpha amino, an alpha-omega diamino, a pendant D-amino, a pendant D-diamino, a pendant T-amino or a pendant T-diamino group.

In another embodiment, the rejuvenating oil is a blend of two or more amino-functional organopolysiloxanes.

In another embodiment, the rejuvenating oil is a blend of the amino-functional organopolysiloxane and a non-functional silicone oil.

In one embodiment, the fluorosilicone elastomer is a crosslinked fluorosilicone elastomer formed by a platinum-catalyzed crosslinking reaction between a vinyl-functional fluorosilicone and at least one of a hydride-functional silicone or a hydride-functional fluorosilicone, and wherein the infrared-absorbing filler comprising carbon black is dispersed throughout the vinyl-functional fluorosilicone before the crosslinking reaction.

In another embodiment, the infrared-absorbing filler further comprises one or more of a metal oxide, carbon nanotubes, graphene, graphite, and carbon fibers.

In one embodiment, the step of applying a rejuvenating oil comprising an amino-functional organopolysiloxane to the reimageable surface layer comprises manually applying the rejuvenating oil using a low durometer silicone hand roller or a textile web to the reimageable surface layer of the imaging member while the imaging member is either rotating or stationary.

The foregoing and/or other aspects and utilities embodied in the present disclosure may be achieved by providing an imaging member comprising:

a. a reimageable surface layer disposed on a structural mounting layer, the reimageable surface layer comprising a fluorosilicone elastomer and an infrared-absorbing filler comprising carbon black;

b. a plurality of surface defects on the reimageable surface layer, wherein the surface defects comprises carbon black exposed through the fluorosilicone elastomer;

c. a coating of rejuvenating oil comprising an amino-functional organopolysiloxane on the reimageable surface layer, such that at least a portion of the plurality of surface defects comprising carbon black are coated by the amino-functional organopolysiloxane.

In an embodiment of the imaging member, the amino-functional organopolysiloxane has the following Formula:

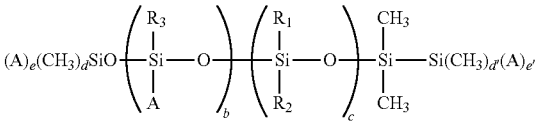

wherein i. A represents —$R_4$—X;

ii. X represents —$NH_2$ or —$NHR_5NH_2$;

iii. $R_4$ and $R_5$ are the same or different and each is an alkyl having from about 1 to about 10 carbons;

iv. $R_1$ and $R_2$ are the same or different and each is an alkyl having from 1 to 25 carbons, an aryl having from 4 to 10 carbons, or an arylalkyl;

v. $R_3$ is an alkyl having from 1 to 25 carbons, an aryl having from 4 to 10 carbons, an arylalkyl, or a substituted diorganosiloxane chain having from 1 to 500 siloxane units;

vi. b and c are numbers and are the same or different and each satisfy the conditions of $0 \leq b \leq 10$ and $10 \leq c \leq 1{,}000$; and vii. d and d' are numbers and are the same or different and are 2 or 3, and e and e' are numbers and are the same or different and are 0 or 1 and satisfy the conditions that $d+e=3$ and $d'+e'=3$, and viii. b, e, and e' must not all be 0 at the same time.

In another embodiment of the imaging member, the amino-functional organopolysiloxane comprises an amino-functional group present in an amount of from 0.01 to 0.7 mol % amine.

In yet another embodiment of the imaging member, the amino-functional organopolysiloxane comprises an alpha amino, an alpha-omega diamino, a pendant D-amino, a pendant D-diamino, a pendant T-amino or a pendant T-diamino group.

In another embodiment of the imaging member, the rejuvenating oil is a blend of two or more amino-functional organopolysiloxanes.

In an embodiment of the imaging member, the rejuvenating oil is a blend of the amino-functional organopolysiloxane and a non-functional silicone oil.

In another embodiment of the imaging member, the fluorosilicone elastomer is a crosslinked fluorosilicone elastomer, and the infrared-absorbing filler comprising carbon black is dispersed throughout the crosslinked fluorosilicone.

In another embodiment of the imaging member, the infrared-absorbing filler further comprises one or more of a metal oxide, carbon nanotubes, graphene, graphite, and carbon fibers.

BRIEF DESCRIPTION OF THE DRAWINGS

These and/or other aspects and advantages in the embodiments of the disclosure will become apparent and more readily appreciated from the following description of the various embodiments, taken in conjunction with the accompanying drawings of which.

Figure 1A:
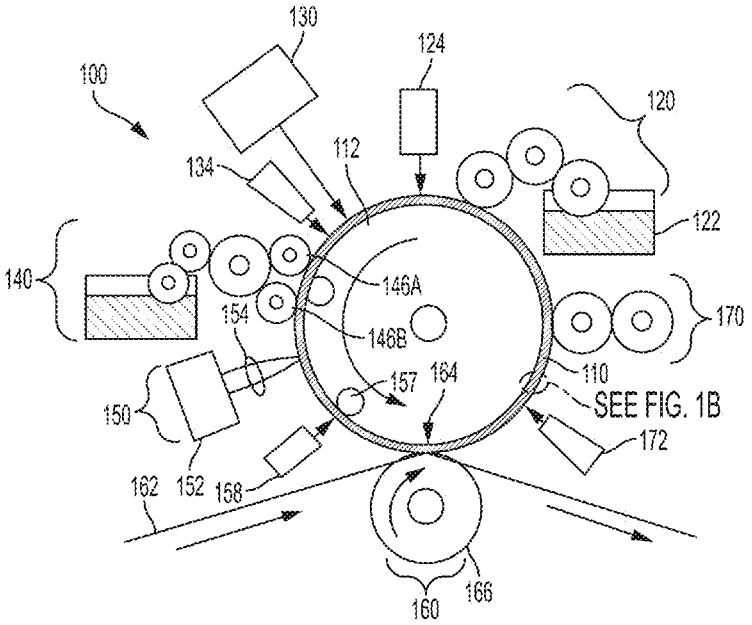
FIG. 1A (PRIOR ART)
FIG. 1A schematically illustrates a conventional ink-based digital printing system.

It should be noted that some details of the drawings have been simplified and are drawn to facilitate understanding of the present teachings rather than to maintain strict structural accuracy, detail, and scale.

The drawings above are not necessarily to scale, with emphasis instead generally being placed upon illustrating the principles in the present disclosure. Further, some features may be exaggerated to show details of particular components. These drawings/figures are intended to be explanatory and not restrictive.

DETAILED DESCRIPTION

Reference will now be made in detail to the various embodiments in the present disclosure. The embodiments are described below to provide a more complete understanding of the components, processes and apparatuses disclosed herein. Any examples given are intended to be illustrative, and not restrictive. Throughout the specification and claims, the following terms take the meanings explicitly associated herein, unless the context clearly dictates otherwise. The phrases "in some embodiments" and "in an embodiment" as used herein do not necessarily refer to the same embodiment(s), though they may. Furthermore, the phrases "in another embodiment" and "in some other embodiments" as used herein do not necessarily refer to a different embodiment, although they may. As described below, various embodiments may be readily combined, without departing from the scope or spirit of the present disclosure.

As used herein, the term "or" is an inclusive operator, and is equivalent to the term "and/or," unless the context clearly dictates otherwise. The term "based on" is not exclusive and allows for being based on additional factors not described, unless the context clearly dictates otherwise. In the specification, the recitation of "at least one of A, B, and C," includes embodiments containing A, B, or C, multiple examples of A, B, or C, or combinations of A/B, A/C, B/C, etc. In addition, throughout the specification, the meaning of "a," "an," and "the" include plural references. The meaning of "in" includes "in" and "on."

All physical properties that are defined hereinafter are measured at 20° to 25° Celsius unless otherwise specified. The term "room temperature" refers to 25° Celsius unless otherwise specified.

When referring to any numerical range of values herein, such ranges are understood to include each and every number and/or fraction between the stated range minimum and maximum. For example, a range of 0.5-6% would expressly include all intermediate values of 0.6%, 0.7%, and 0.9%, all the way up to and including 5.95%, 5.97%, and 5.99%. The same applies to each other numerical property and/or elemental range set forth herein, unless the context clearly dictates otherwise.

While the rejuvenating oil composition and methods for rejuvenating an imaging member are discussed here in relation to ink-based digital offset printing or variable data lithographic printing systems, embodiments of the rejuvenating oil composition, and methods for rejuvenating an imaging member using the same, may be used for printing applications other than ink-based digital offset printing or variable data lithographic printing systems.

The term "organopolysiloxane" is used interchangeably with "siloxane", "silicone", "silicone oil" and "silicone rubber" and "polyorganosiloxanes" and is well understood to those of skill in the relevant art to refer to siloxanes having a backbone formed from silicon and oxygen atoms and sidechains containing carbon and hydrogen atoms. For the purposes of this application, the term "silicone" should also be understood to exclude siloxanes that contain fluorine atoms, while the term "fluorosilicone" is used to cover the class of siloxanes that contain fluorine atoms. Other atoms may be present in the silicone, for example, nitrogen atoms in amine groups which are used to link siloxane chains together during crosslinking.

The term "fluorosilicone" as used herein refers to siloxanes having a backbone formed from silicon and oxygen atoms, and sidechains containing carbon, hydrogen, and fluorine atoms. At least one fluorine atom is present in the sidechain. The sidechains can be linear, branched, cyclic, or aromatic. The fluorosilicone may also contain functional groups, such as amino groups, which permit addition crosslinking. When the crosslinking is complete, such groups become part of the backbone of the overall fluorosilicone. The side chains of the organopolysiloxane can also be alkyl or aryl. Fluorosilicones are commercially available, for example, CFI-3510 and CF3502 from NuSil or SLM (n-27) from Wacker.

The term "receiving substrate" is used interchangeably with the terms "print media", "print substrate" and "print sheet" and refers to a usually flexible physical sheet of paper, polymer, Mylar material, plastic, or other suitable physical print media substrate, sheets, webs, etc., for images, whether precut or web fed.

As used herein, the term "ink-based digital printing" is used interchangeably with "variable data lithography printing" and "digital offset printing," to refer to lithographic printing of variable image data for producing images on a substrate that are changeable with each subsequent rendering of an image on the substrate in an image forming process. As used herein, the "Ink-based digital printing" includes offset printing of ink images using lithographic ink where the images are based on digital image data that may vary from image to image. As used herein, the ink-based digital printing uses a "digital architecture for lithographic ink (DALI)" or a variable data lithography printing system or a digital offset printing system, where the system is configured for lithographic printing using lithographic inks and based on digital image data, which may vary from one image to the next. As used herein, an ink-based digital printing system using a "digital architecture for lithographic ink (DALI)" is referred as a DALI printer. As used herein, an imaging member of a DALI printer is referred interchangeably as a DALI printing plate and a DALI imaging blanket.

Ink-Based Digital Printing System

Figure 1B:
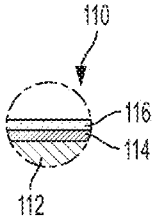
FIG. 1B schematically illustrates a cross sectional view of an imaging member of the ink-based digital printing system of FIG. 1A.

FIG. 1A illustrates a conventional printer 100 for ink-based digital printing. The printer 100 includes an imaging member 110. FIG. 1B schematically illustrates a cross sectional view of an imaging member 110 of the ink-based digital printing system 100. As shown in FIG. 1B, the imaging member 110 comprises a substrate such as a rotating drum 112; a structural mounting layer 114 (or a carcass layer) disposed on the substrate 112, and a reimageable surface layer 116 disposed on the structural mounting layer 114. The structural mounting layer 114 may be Sulphur free, even though the surface layer is not limited to a specific carcass. Further, the structural mounting layer 114 may be made of any suitable material having sufficient tensile strength, such as for example, polyester, polyethylene, polyamide, fiberglass, polypropylene, vinyl, polyphenylene, sulphide, aramids, cotton fiber, cotton weave backing, or any combination thereof.

In the printer 100, the reimageable surface layer 116 includes a fluorosilicone elastomer and an infrared-absorbing filler such as carbon black. The reimageable surface layer 116 forms the topcoat layer and is the outermost layer of the imaging member 110, i.e. the reimageable surface layer 116 of the imaging member 110 is the furthest from the substrate 112.

In an embodiment, the reimageable surface layer 116 can further include another infrared-absorbing filler besides carbon black. The infrared-absorbing filler can be any suitable material that can absorb laser energy or other highly directed energy in an efficient manner. Examples of suitable infrared-absorbing filler materials include, but are not limited to, metal oxide, carbon nanotubes, graphene, graphite, carbon fibers, and combinations thereof. For the purposes of this disclosure, metal oxide is defined to include oxides of both metals, such as iron oxide (FeO) and metalloids, such as silica.

The infrared-absorbing filler may be microscopic (e.g., average particle size of less than 10 micrometers) to nanometer sized (e.g., average particle size of less than 1000 nanometers). For example, infrared-absorbing filler may have an average particle size of from about 2 nanometers (nm) to about 10 μm, or from about 20 nm to about 5 μm. In another embodiment, the infrared-absorbing filler has an average particle size of about 100 nm. Preferably, the infrared-absorbing filler is carbon black. In another example, the infrared-absorbing filler is a low-sulphur carbon black, such as Emperor 1600 (available from Cabot). The inventors found that the sulphur content needs to be controlled for a proper cure of the fluorosilicone. In an example, a sulphur content of the carbon black is 0.3% or less. In another example, the sulphur content of the carbon black is 0.15% or less.

The fluorosilicone elastomer composition of the reimageable surface layer 116 may include between 5% and 30% by weight infrared-absorbing filler based on the total weight of the fluorosilicone elastomer composition. In an embodiment, the fluorosilicone elastomer includes between 15% and 35% by weight infrared-absorbing filler. In yet another embodiment, the fluorosilicone elastomer includes about 20% by weight infrared-absorbing filler based on the total weight of the fluorosilicone elastomer composition.

In exemplary embodiments, the fluorosilicone elastomer composition of the reimageable surface layer 116 may further include wear resistant filler material such as silica to help strengthen the fluorosilicone and optimize its durometer. For example, in one embodiment, the fluorosilicone elastomer composition includes between 1% and 5% by weight silica based on the total weight of the fluorosilicone elastomer composition. In another embodiment, the fluorosilicone elastomer includes between 1 and 4% by weight silica. In yet another embodiment, the fluorosilicone elastomer includes about 1.15% by weight silica based on the total weight of the fluorosilicone elastomer composition. The silica may have an average particle size of from about 10 nm to about 0.2 μm. In one embodiment, the silica may have an average particle size of from about 50 nm to about 0.1 μm. In another embodiment, the silica has an average particle size of about 20 nm.

In another embodiment, the fluorosilicone elastomer composition of the reimageable surface layer 116 may also contain platinum catalyst particles to help cure and cross link the fluorosilicone material.

In an embodiment, the fluorosilicone elastomer is a crosslinked fluorosilicone elastomer and the infrared-absorbing filler comprising carbon black is dispersed throughout the crosslinked fluorosilicone. The crosslinked fluorosilicone can be formed by a platinum-catalyzed crosslinking reaction between a vinyl-functional fluorosilicone and at least one of a hydride-functional silicone or a hydride-functional fluorosilicone. The infrared-absorbing filler comprising carbon black is dispersed throughout the vinyl-functional fluorosilicone before the crosslinking reaction, thereby resulting the infrared-absorbing filler dispersed throughout the crosslinked fluorosilicone elastomer. In an embodiment, the vinyl-functional fluorosilicone is vinyl terminated trifluoropropyl methylsiloxane polymer (e.g., Wacker 50330, SML (n=27)). In another embodiment, the hydride-functional fluorosilicone is methyl hydro siloxane trifluoropropyl methylsiloxane (Wacker SLM 50336). The reaction mixture comprising a vinyl-functional fluorosilicone, at least one of a hydride-functional silicone or a hydride-functional fluorosilicone, an infrared-absorbing filler and a platinum catalyst may further include one or more of silica particles, dispersant, and a platinum catalyst inhibitor. In an embodiment, the reaction mixture is essentially free of Sulphur.

While not being limited to a particular feature, a primer layer (not shown) may be applied between the structural mounting layer 114 and the reimageable surface layer 116 to improve adhesion between the said layers. An example of a material suitable for use as the primer layer is a siloxane based with the main component being octamethyl trisiloxane (e.g., S11 NC commercially available from Henkel). In addition, an inline corona treatment can be applied to the structural mounting layer 114 and/or primer layer for further improved adhesion, as readily understood by a skilled artisan.

Imaging members and more specifically compositions of structural mounting layers and fluorosilicone elastomers for the reimageable surface layer are described in detail in U.S. Pat. No. 9,283,795, U.S. Patent Publication No. 2016/0176185, and U.S. patent application Ser. No. 15/222,364, the disclosures of which are incorporated by reference herein in their entirety.

In the depicted embodiment shown in FIG. 1A, the imaging member rotates counterclockwise and starts with a clean surface. Disposed at a first location is a dampening fluid subsystem 120, which uniformly wets the reimageable surface layer 116 with a dampening fluid 122 to form a layer having a uniform and controlled thickness. Ideally the dampening fluid layer is between about 0.15 micrometers and about 1.0 micrometers in thickness, is uniform, and is without pinholes. As explained further below, the composition of the dampening fluid aids in leveling and layer thickness uniformity. A sensor 124, such as an in-situ non-contact laser gloss sensor or laser contrast sensor, is used to confirm the uniformity of the layer. Such a sensor can be used to automate the dampening fluid subsystem 120.

At the optical patterning subsystem 130, the dampening fluid layer is exposed to an energy source (e.g. a laser) that selectively applies energy to portions of the layer to imagewise evaporate the dampening fluid and create a latent "negative" of the ink image that is desired to be printed on the receiving substrate. Image areas are created where ink is desired, and non-image areas are created where the dampening fluid remains. An air knife 134 is used to control airflow over the reimageable surface layer 116 for maintaining a clean dry air supply, a controlled air temperature, and for reducing dust contamination prior to inking. Next, an ink composition is applied to the imaging member using inker subsystem 140. The inker subsystem 140 may consist of a "keyless" system using an anilox roller to meter an offset ink composition onto one or more forming rollers 146A, 146B. The ink composition is applied to the image areas to form an ink image.

A rheology control subsystem 150 partially cures or tacks the ink image. This curing source may be, for example, an ultraviolet light emitting diode (UV-LED) 152, which can be focused as desired using optics 154. Another way of increasing the cohesion and viscosity employs cooling of the ink composition. This could be done, for example, by blowing cool air over the reimageable surface layer 116 from the jet 158 after the ink composition has been applied but before the ink composition is transferred to the receiving substrate 162. Alternatively, a heating element (not shown) could be used near the inker subsystem 140 to maintain a first temperature and a cooling element 157 could be used to maintain a cooler second temperature near the nip 164.

The ink image is then transferred to the target or receiving substrate 162 at transfer subsystem 160. This is accomplished by passing a recording medium or receiving substrate 162, such as paper, through the nip 164 between the impression roller 166 and the imaging member 110.

Finally, the imaging member 110 should be cleaned of any residual ink or dampening fluid. Most of this residue can be easily removed quickly using an air knife 172 with sufficient airflow. Removal of any remaining ink can be accomplished at cleaning subsystem 170.

Over time, the mechanical stresses due to repeated contact of the reimageable surface layer 116 of the imaging member 110 with the receiving substrate 162 results in wearing off the fluorosilicone elastomer from the reimageable surface layer. Such wearing off the fluorosilicone elastomer can lead to carbon black being exposed through the fluorosilicone elastomer of the reimageable surface layer as surface defects (not shown). These surface defects are of higher surface energy than the fluorosilicone elastomer of the reimageable surface layer and can cause background imaging defects and thus shorter life of the reimageable surface layer.

To rejuvenate the imaging member, a rejuvenating oil, as disclosed herein below, comprising an amino-functional organopolysiloxane can be applied to the reimageable surface layer 116, such that at least a portion of the plurality of surface defects are selectively coated by the amino-functional organopolysiloxane present in the rejuvenating oil, thereby lowering the surface energy of the surface defects on the reimageable surface layer. Hence, rejuvenation of the imaging member provides one way of increasing the life of the imaging member.

Rejuvenating Oil

As used herein and disclosed above, both "organopolysiloxane" and "fluorosilicone" refer to siloxanes having a backbone formed from silicon and oxygen atoms and sidechains containing carbon and hydrogen atoms mainly and other atoms such as nitrogen atoms in amino groups with the proviso that fluorosilicone has at least one fluorine atom in the sidechain. The sidechains of the organopolysiloxanes and the fluorosilicones can be alkyl, aryl, arylalkyl or a combination thereof.

The term "alkyl" as used herein refers to a radical, which is composed entirely of carbon atoms and hydrogen atoms, which is fully saturated, such as methyl, ethyl, propyl, butyl, cyclobutyl, cyclopentyl, and the like.

The term "aryl" refers to an aromatic radical composed entirely of carbon atoms and hydrogen atoms. When aryl is described in connection with a numerical range of carbon atoms, it should not be construed as including substituted aromatic radicals. For example, the phrase "aryl containing from 6 to 10 carbon atoms" should be construed as referring to a phenyl group (6 carbon atoms) or a naphthyl group (10 carbon atoms) only, and should not be construed as including a methylphenyl group (7 carbon atoms).

Suitable alkylaryl group includes such as methylphenyl, ethylphenyl, propylphenyl, and the like.

The term "amino" refers to a group containing a nitrogen atom attached by a single bond to hydrogen atoms, alkyl groups, aryl groups or a combination thereof.

In an embodiment, the rejuvenating oil comprises an amino-functional organopolysiloxane. In one embodiment, the amino-functional organopolysiloxane has the Formula 1, as shown below:

(1)

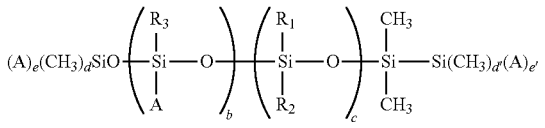

wherein i. A represents —$R_4$—X;

ii. X represents —$NH_2$ or —$NHR_5NH_2$;

iii. $R_4$ and $R_5$ are the same or different and each is an alkyl having from about 1 to about 10 carbons;

iv. $R_1$ and $R_2$ are the same or different and each is an alkyl having from 1 to 25 carbons, an aryl having from 4 to 10 carbons, or an arylalkyl;

v. $R_3$ is an alkyl having from 1 to 25 carbons, an aryl having from 4 to 10 carbons, an arylalkyl, or a substituted diorganosiloxane chain having from 1 to 500 siloxane units;

vi. b and c are numbers and are the same or different and each satisfy the conditions of $0 \le b \le 10$ and $10 \le c \le 1{,}000$; and ix. d and d' are numbers and are the same or different and are 2 or 3, and e and e' are numbers and are the same or different and are 0 or 1 and satisfy the conditions that d+e=3 and d'+e'=3, and vii. b, e, and e' must not all be 0 at the same time.

Examples of suitable amino-functional organopolysiloxanes for use as rejuvenating oil include those organopolysiloxanes having pendant and/or terminal amino groups. The amino groups can be monoamino, diamino, triamino, tetraamino, pentaamino, hexaamino, heptaamino, octaamino, nonaamino, decaamino, and the like. In some embodiments, the amino group is alpha or alpha-omega amino (terminal to the siloxane chain), D-amino (pendant to the chain), T-amino (pendant to the chain at branch point), or the like.

In an embodiment, the rejuvenating oil may include an alpha-omega amino-functional organopolysiloxane having the Formula 1, where b is 0; c is from about 10 to about 1,000; d and d' are 2; e and e' are 1; and $R_3$ is other than a diorganosiloxane chain.

In another embodiment, the rejuvenating oil includes an alpha amino-functional organopolysiloxane having the Formula 1, where b is 0; c is from about 10 to about 1000; d is 2; e is 1; d' is 3; e' is 0; and $R_3$ is other than a diorganosiloxane chain.

In another embodiment, the rejuvenating oil includes a pendant D-amino-functional organopolysiloxane having the Formula 1, where b is from about 1 to about 10; c is from about 10 to about 1,000; d and d' are 3; e and e' are 0; and $R_3$ is other than a diorganosiloxane chain.

In another embodiment, the rejuvenating oil includes a pendant T-amino-functional organopolysiloxane having the above Formula 1, where b is from about 1 to about 10; c is from about 10 to about 1,000; d and d' are 3; e and e' are 0; and $R_3$ is a diorganosiloxane chain.

In yet another embodiment, the rejuvenating oil includes a T-type amino-functional release agent having the Formula 1, where b, e and e' are at least 1.

In certain embodiments, X represents —$NH_2$, and in other embodiments, $R_4$ is propyl. In some embodiments, X represents —$NHR_5NH_2$, and in some other embodiments, $R_5$ is propyl.

In specific embodiments, the amino-functional organopolysiloxane fluid has the following general formulas, as shown below. In the formulas below, the diorgano-substitutions on silicon are not shown.

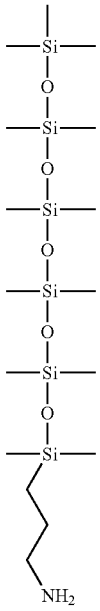
alpha amino
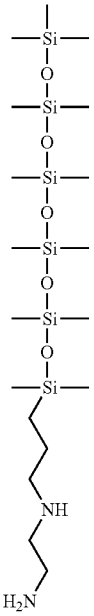
alpha-omega diamino
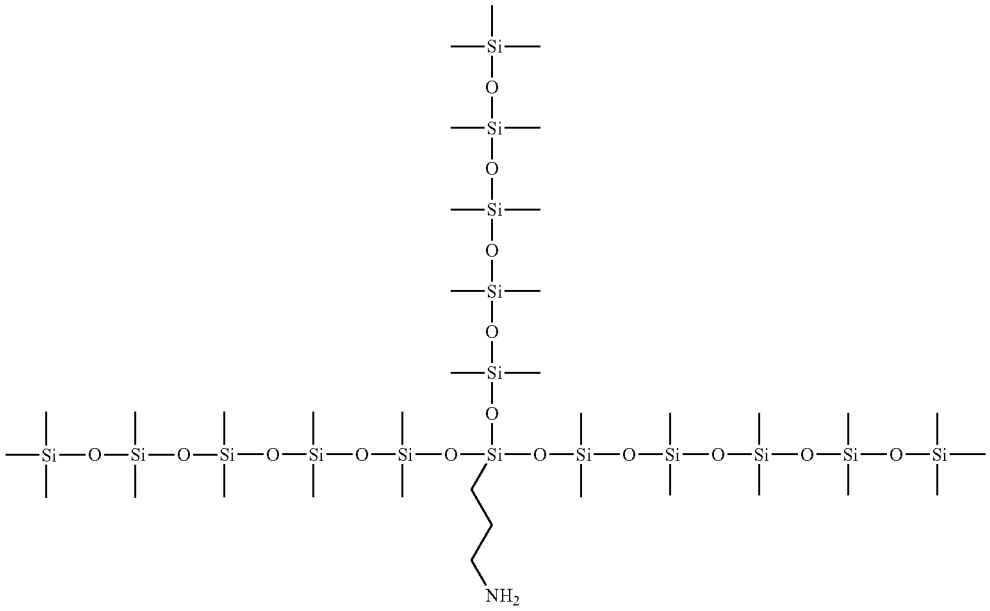
Si
O
Si
O
Si
O
Si
O
Si
O
Si
O -continued

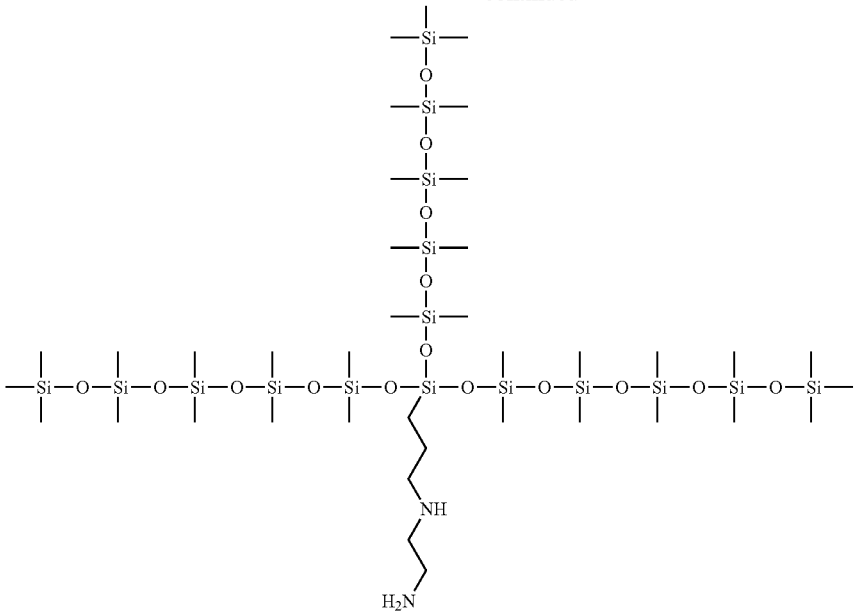

pendant T diamino

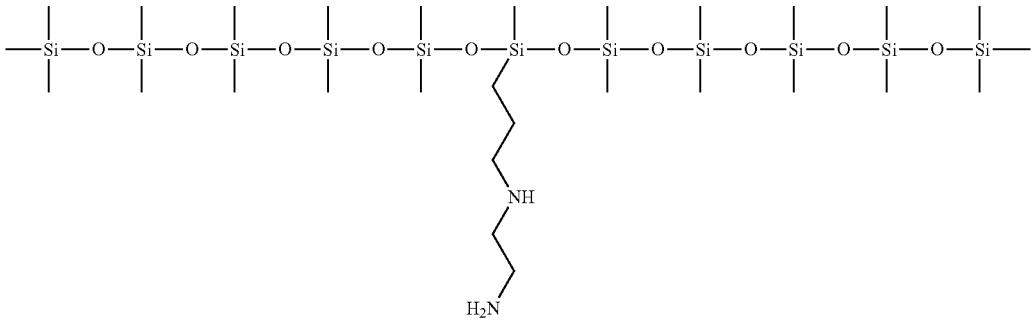

pendant D diamino

As may be observed from the formulas above, the functional amino group can be at some random point in the backbone of the chain of the organopolysiloxane, which is flanked by trialkylsiloxy end groups. In addition, the amino group may be a primary amine, a secondary amine, or a tertiary amine. In one embodiment, the amino-functional organopolysiloxane for use as the rejuvenating oil includes an amino-functional group that is a primary amino-functional group. In another embodiment, the amino-functional organopolysiloxane includes a primary amino-functional group, and one or more of a secondary amino group, and a tertiary amino group. In one embodiment, the amino-functional organopolysiloxane present in the rejuvenating oil includes an alpha amino, an alpha-omega diamino, a pendant D-amino, a pendant D-diamino, a pendant T-amino or a pendant T-diamino group.

As used herein, the term "mol % of amino-functional groups" is used interchangeably with "mole % amine" and refers to the relationship:

$$\text{Mol\% of amino-functional groups or mol\% amine} = 100 \times \frac{\text{moles of amino-functional groups}}{\text{moles of silicon atoms}}$$

In an embodiment, the amino-functional organopolysiloxane present in the rejuvenating oil comprises an amino-functional group present in an amount of from about 0.01 to about 0.7 mol % amine, or from about 0.03 to about 0.5 mol % amine, or from about 0.05 to about 0.3 mol % amine, or from about 0.05 to about 0.15 mol % amine, based on the moles of the silicon as shown above in the formula. In yet another embodiment, the rejuvenating oil comprises an amino-functional organopolysiloxane having a diamino-functional group present in an amount of from about 0.02 to about 1.4 mol % amine, or from 0.05 to about 1.3 mol % amine, or from about 0.1 to about 1.3 mol % amine, or from about 0.3 to about 0.7 mol % amine, based on the moles of the silicon as shown above in the formula.

In another embodiment, the rejuvenating oil is a blend of two or more of the amino-functional organopolysiloxane, as disclosed hereinabove having Formula 1. Each of the two or more amino-functional organopolysiloxanes present in the rejuvenating oil as a blend can be chosen from an alpha amino, an alpha-omega diamino, a pendant D-amino, a pendant D-diamino, a pendant T-amino or a pendant T-diamino group. In such rejuvenating oils, the primary amino group and the secondary amino may be present in a ratio of 1:1, 2:1, 3:1, 4:1, 1:2, 1:3, or 1:4. In an embodiment, the rejuvenating oil is a blend of two or more of the above-described amino-functional organopolysiloxane having amino-functional groups present in an amount of at least 0.05 mol % amine, or at least 0.06 mol % amine, or at least 0.07 mol % amine, or at least 0.08 mol % amine, or at least 0.09 mol % amine, or at least 0.1 mol % amine, or at least 0.2 mol % amine, or at least 0.3 mol % amine or at least 0.35 mol % amine, or at least 0.6 mol % amine, based on the moles of the silicon.

In some embodiments, the rejuvenating oil is a blend of an amino-functional organopolysiloxane and a non-functional organopolysiloxane (silicone oil). As used herein, the term "nonfunctional oil" refers to oils that do not have chemical functionality which interacts or chemically reacts with the surface of the fuser member or with fillers on the surface. A functional oil, as used herein, refers to a rejuvenating oils having functional groups which chemically react with the carbon black present as high surface energy point defects exposed through the fluorosilicone elastomer surface layer of the imaging member, so as to reduce the surface energy of the of the surface of the reimageable fluorosilicone elastomer surface layer. If the high surface energy point defects are not reduced, the ink tends to adhere to the point defects on the imaging member's surface, which results in print quality defects.

Typical amino-functional organopolysiloxanes include but are not limited to, for example, methyl aminopropyl dimethyl siloxane, ethyl aminopropyl dimethyl siloxane, benzyl aminopropyl dimethyl siloxane, dodecyl aminopropyl dimethyl siloxane, aminopropyl methyl siloxane, pendant propylamine polydimethylsiloxane, pendant N-(2-aminoethyl)-3-aminopropyl polydimethylsiloxane, terminal propylamine polydimethylsiloxane, and the like. These amino-functional organopolysiloxanes typically have a viscosity of from about 100 to about 900 cSt, or about 200 to about 600 cSt, or about 200 to about 500 cSt, or about 250 to about 400 cSt at 20° C.

In an embodiment, the amino-functionality is provided by aminopropyl methyl siloxy groups for the rejuvenating oil, aminopropyl polydimethylsiloxane.

Commercial examples of rejuvenating oil comprising an monoamino-functional organopolysiloxane include, but are not limited to those shown in the table 1 below, all available from Xerox Corporation:

TABLE 1

| Type of amino-functional group | Amino-functional organopolysiloxane | | Trade | Available | Viscosity, | Mole % primary amino-functional group |
|---|---|---|---|---|---|---|
| | Name | Structure | Name | from | cSt | (—NH2) |
| Mono-amino | Pendantpropyl amine PDMS | 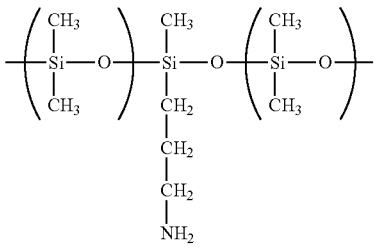 | Fuser Shield | Xerox Corp, Rochester, NY | 270 -330 | 0.06%-0.09% |
| | | | Fuser Agent II | | 350 | 0.08% |
| | | | Fuser Fluid | | 100 | 0.2 |
| | | | Fuser Fluid II | | | 0.09% & 0.24% |

In another embodiment, the amino-functionality in the rejuvenating oil is provided by N-(2-aminoethyl)-3-aminopropyl siloxy groups or by the terminal propylamine siloxy groups as shown below in the Table 2:

| Type of amino-functional group | Amino-functional organopolysiloxane Name | Structure | Viscosity, cSt | Mole % primary amino-functional group (—NH2) |
|---|---|---|---|---|
| diamino | Pendant N-(2-aminoethyl)-3-aminopropyl PDMS | 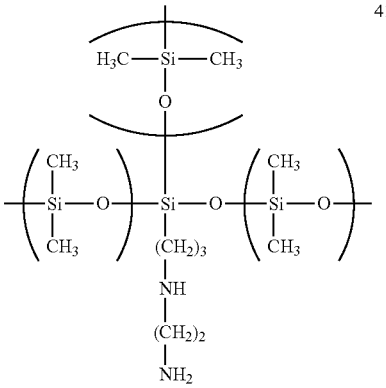 | 410-860 | 0.37-0.63% |
| alpha-omega amino | Terminal propylamine PDMS | 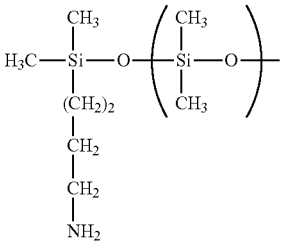 | 220-860 | 0.058-0.107% |

Methods of preparation of amino-functional organopolysiloxanes are disclosed in U.S. Pat. No. 7,208,258, the disclosure of which is incorporated by reference herein in its entirety.

In an aspect, there is a use of a rejuvenating oil comprising an amino-functional organopolysiloxane as disclosed hereinabove, for rejuvenation of an imaging member of an ink-based digital printing system, the imaging member comprising an at least partly worn off reimageable surface layer having a plurality of surface defects. The imaging member having the at least partly worn off reimageable surface layer includes a substrate in the form of a drum, a belt, or a plate; a structural mounting layer disposed on the substrate, and a partly worn off reimageable surface layer disposed on the structural mounting layer. The reimageable surface layer of the imaging member includes a fluorosilicone elastomer and carbon black as an infrared-absorbing filler. The surface defects on the reimageable surface layer are formed when the carbon black is exposed on a surface of the reimageable surface layer through the fluorosilicone elastomer. Upon coating a uniform layer of the rejuvenating oil of the present disclosure on to the reimageable surface layer, at least a portion of the plurality of surface defects are coated by the amino-functional organopolysiloxane present in the rejuvenating oil, which results in the rejuvenation of the imaging member. As a result of the rejuvenation of the imaging member, the print quality of an image printed using the rejuvenated imaging member is restored to a predetermined print quality standard such as the print quality of an image printed using a new or almost new imaging member. In an embodiment, the rejuvenating oil, as disclosed hereinabove can be used as necessary for rejuvenation of the imaging member. In another embodiment, the rejuvenating oil, as disclosed hereinabove can be used for rejuvenating the imaging member at least once after every 500 or 600 print cycles.

Print quality can be tracked any suitable method, including but not limited to visual inspection of background or unprinted area in a print image, such as by visually inspecting if there are any undesired print spots that should not be there. Print quality can also be monitored by periodically measuring the optical density in the background or unprinted area in a print image, such as a test image, as a function of print cycles using an optical densitometer, such as Pantone X-Rite EXACT model. The optical density is measured first on a blank substrate, which is taken to "zero" the densitometer, followed by taking a measurement on the print substrate after a certain number of print cycles.

Method for an Ink-Based Digital Printing System

In an aspect, there is a method for an ink-based digital printing system, comprising providing an imaging member. The imaging member comprises a substrate in the form of a drum, a belt, and a plate; a structural mounting layer disposed on the substrate, and a reimageable surface layer disposed on the structural mounting layer. The reimageable surface layer of the imaging member includes a fluorosilicone elastomer and an infrared-absorbing filler comprising carbon black. The reimageable surface layer may be partly worn off as evident by a degradation in print quality of a print image due to the presence of a plurality of surface defects on the reimageable surface layer. The surface defects are formed as a result of the reimageable surface layer being subjected to mechanical stress of repeated contact with the receiving substrate during printing, which causes the carbon black present in the reimageable surface layer to get exposed through the fluorosilicone elastomer to a surface of the reimageable surface layer. The surface defects on the reimageable surface layer can cause the print quality of a print image to deviate from a predetermined standard value, as shown by background imaging defects on the print image. Such surface defects can also shorten the life of the imaging member.

The method for an ink-based digital printing system further comprises applying a coating of rejuvenating oil including an amino-functional organopolysiloxane, as disclosed hereinabove to the reimageable surface layer. Such an application of a coating of rejuvenating oil results in at least a portion of the plurality of surface defects formed of carbon black being coated by the amino-functional organopolysiloxane present in the rejuvenating oil. The selective coating of the surface defects and in turn of the carbon black by the amino-functional organopolysiloxane rejuvenates and restores the imaging member by lowering the surface energy of the surface defects present on the reimageable surface layer.

The rejuvenated imaging member obtained by the application of a coating of rejuvenating oil on to the reimageable surface layer of the imaging member provides an improvement in print quality of a print image as compared to the print quality of a print image printed before the application of the rejuvenating oil using the same imaging member having a plurality of surface defects.

In one embodiment, the step of applying a rejuvenating oil comprising an amino-functional organopolysiloxane to the surface of the imaging member includes manually applying the rejuvenating oil using a low durometer silicone hand roller or a textile web to the reimageable surface layer of the imaging member while the imaging member is either rotating or stationary.

Since, the ink-based digital printing requires no high temperatures and the rejuvenating oil need to be applied in a very small amount of less than <0.05 gsm (grams per square meter) or less than 0.03 gsm or less than 0.01 gsm per treatment, the rejuvenating oil can be delivered with very low loading levels via the use of a low cost cloth wiping system. In an embodiment, the cloth wiping system is composed of a fine weave high density polyester fabric, with the polyester fabric having a linear density in the range of 10-30 Denier. However, any suitable thin, but strong fabric, such as used in the Xerox commercial oiler Part # BMPAS010911 may be used. Other methods such as squeezy blades and wicks may also be used for the application of rejuvenating oil. A fine weave high density polyester fabric is highly desirable for dosing the surface with the rejuvenating oil, as cloth can be pressed against the surface of the imaging member at pressures that are still low enough not to cause surface wear, but are high enough to allow for good contact and diffusion of oil onto the surface of the imaging member. Furthermore, the cloth material can be controllably loaded with a fixed % weight of rejuvenating oil under a vacuum process which monitors the amount of rejuvenating oil loaded relative to the weight of the wiping material very precisely.

The rejuvenating oil can be applied on an as-needed basis manually. In another embodiment, the step of applying the rejuvenating oil comprises applying the rejuvenating oil after every 500 or 600 print cycles or after any number of prints when the print quality decreases.

A print cycle is now described with reference to the printer 100. A "print cycle" refers to operations of the printer 100 including, but not limited to, preparing an imaging surface for printing, applying fountain solution to the imaging member which consists of infrared absorbing filler, patterning the fountain solution by IR laser, developing the latent image with ink, transferring the image to substrate, and fixing the image on substrate.

In an embodiment of the method for an ink-based digital printing system, the method further comprises preparing the rejuvenated imaging member for printing by applying a fountain solution to the imaging member. The method also includes patterning the fountain solution by IR laser, developing the latent image with an ink, transferring the image to a receiving substrate, and fixing the image on the substrate.

The method also includes periodically monitoring the print quality of a test image printed on a substrate by visual inspection or by measuring the optical density of the background area or the unprinted area of the test image. The method further includes rejuvenating the imaging member once the print quality is below a predetermined threshold. In an embodiment, the predetermined threshold for rejuvenation of the imaging member is having an optical densitometer value of the background area or the unprinted area of a test image of at least 0.1 or 0.11, or 0.12 or 0.13 or 0.15 or 0.15, or 0.2. However, the threshold may be lower than 0.1, such as at least 0.09, or 0.08, or 0.07 or, 0.06 or 0.05.

All the patents and applications referred to herein are hereby specifically, and totally incorporated herein by reference in their entirety in the instant specification.

Aspects of the present disclosure may be further understood by referring to the following examples. The examples are illustrative, and are not intended to be limiting embodiments thereof.

EXAMPLES

Test Methods

Optical Density Measurement

An optical Densitometer from Pantone X-Rite EXACT model was used to measure the optical density in the unprinted areas as a function of print cycles.

The optical densitometer comprised of a light source and a photocell. The light source shines onto a print substrate through a 2 mm aperture and reflects back to the photo detector. An optical densitometer measurement on a blank substrate was first taken to "zero" the densitometer, followed by taking a measurement on the print substrate.

Screening of Siloxanes as Rejuvenating Oils

Various functional and non-functional siloxanes were screened for use as potential rejuvenating oil. The screening was done by visual inspection of the wetting behavior of various oils on a surface of a DALI imaging blanket, with the premise that if an oil failed to wet the surface of the DALI imaging blanket, then the same oil would also fail to deposit as a uniform and thin layer on the surface of the DALI imaging blanket, and in turn fail to rejuvenate uniformly the entire surface of the DALI imaging member. Hence, a good wetting behavior is a prerequisite to being rejuvenating oil.

Oil screening for performance evaluation especially wetting of the surface was done off line. A 4"×4" piece of the DALI imaging blanket was glued onto aluminum shim. A drop of the oil was put on the DALI imaging blanket surface and lightly rubbed with a piece of rag. The wetting attribute of the oils was visually observed. The amino oils spread nicely and did not bead up while others bead up indicating non wetting behavior. Some oils caused swelling of the blanket. Table 3 summarizes the results of the wetting behavior of various siloxanes:

TABLE 3

Wetting Behavior of various siloxanes:

| | Type of Rejuvenating oil | Chemical Structure | Available from | Visual Observation |
|---|---|---|---|---|
| Example 1 | Amino-functional PDMS | 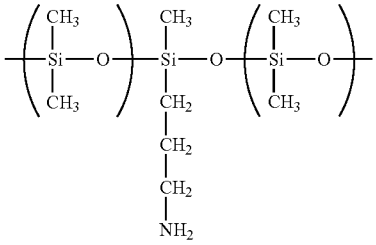 | Xerox Corporation | Wetted the blanket surface the best among all siloxanes that were tested |
| Example 2 | Diamino PDMS | 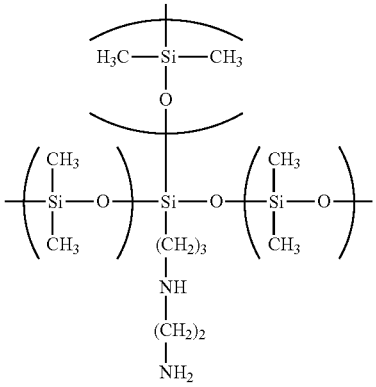 | Wacker Silicones | Wetted the blanket surface, but not enough in comparison to Example 1, but better than Comparative Examples A-D |
| Comparative Example A | Nonfunctional PDMS | 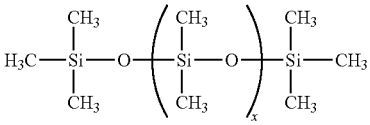 | Wacker Silicones & Dow Corning | Did not wet the blanket surface |
| Comparative Example B | Mercapto functional Polydimethyl-siloxane (PDMS) | 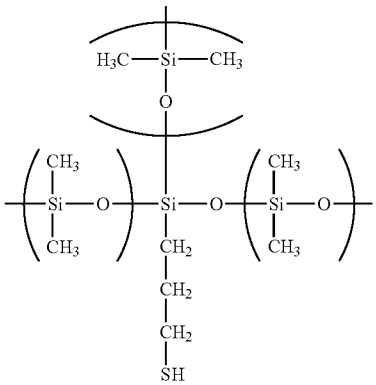 | Wacker Silicones & Dow Corning | Inadequately wetted the blanket surface |
| Comparative Example C | Hydride-functional PDMS | 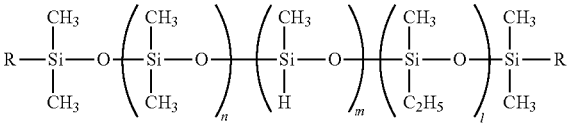 | Gelest | Inadequately wetted the blanket surface |

TABLE 3-continued

| Wetting Behavior of various siloxanes: | | | | |
|---|---|---|---|---|
| | Type of Rejuvenating oil | Chemical Structure | Available from | Visual Observation |
| Comparative Example D | Fluoro functional PDMS | 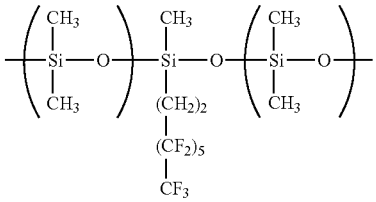 | Wacker Silicones | Swelled the blanket |

As can be seen from the Table 3, only amino-functional siloxanes, both monoamino and diamino-functional siloxanes wetted the surface of the DALI imaging blanket, though mono-amino-functional siloxane was the best. Other siloxanes, such as non-functional siloxane (Comparative Example A) and mercapto-functional siloxanes (Comparative Example B) and hydride-functional siloxanes (Comparative Example C) did not wet the surface. Fluoro-functional siloxane (Comparative Example D) swelled the imaging blanket and therefore also failed. This was a surprising and an unexpected result that among all of the siloxanes that were tested, some of which are available as fuser oils, only the amino-functional siloxanes wetted the surface enough to be considered as the potential rejuvenating oil. The amino-functional oil of Example 1 was further evaluated as rejuvenating oil.

Example 3: Rejuvenation of an Imaging Member Using a Rejuvenating Oil Comprising Propylamine Polydimethylsiloxane of Example 1

Rejuvenating oil of Example 1 comprising pendant propylamine polydimethylsiloxane (PPA-PDMS), having a viscosity of 575 cSt at 20° C. and 0.24 mol % amine, commercially available as Fuser Fluid II from Xerox Corporation, Rochester, N.Y. was used in a DALI test fixture to evaluate the extent of rejuvenation of the DALI imaging blanket.

The DALI test fixture, used to develop the DALI print technology, comprises various subsystems as described above for printer 100 for ink-based digital printing, including, but not limited to, a cylindrical imaging member comprising a reimageable surface layer including fluorosilicone elastomer and carbon black, a dampening fluid subsystem, a sensor, an optical patterning subsystem, an air knife, an inker subsystem, a rheology control subsystem, a transfer subsystem, and a cleaning subsystem. A thin coating of rejuvenating oil as described above was manually applied to the surface of the reimageable surface layer of the DALI printing plate, i.e. imaging member. The rejuvenating oil was applied using a low durometer silicone or EPDM hand roller, having a hardness of 30 Durometer, that had been immersed in the rejuvenating oil. The low durometer of the roller allowed the DALI imaging member to be uniformly covered with the rejuvenating oil. After manual application of the rejuvenating oil, a printing paper was run to remove oil until the surface appeared dry, which is usually 3-6 print cycles.

After about 600 print cycles, the inker and the paper were lifted from the DALI imaging member and the low durometer hand roller was brought firmly against the imaging member as it was rotating, to deliver a thin layer of rejuvenating oil over the surface of the DALI imaging member. The paper path was re-engaged for three to six print cycles, without the inker, to take up any residual oil. The inker was then engaged and printing was resumed. The printing substrate used was McCoy #80 glossy paper, which is a flat clay coated paper. The print speed varied from 30-50 cm/sec. A test image was printed periodically to monitor the quality of the image.

Figure 2:
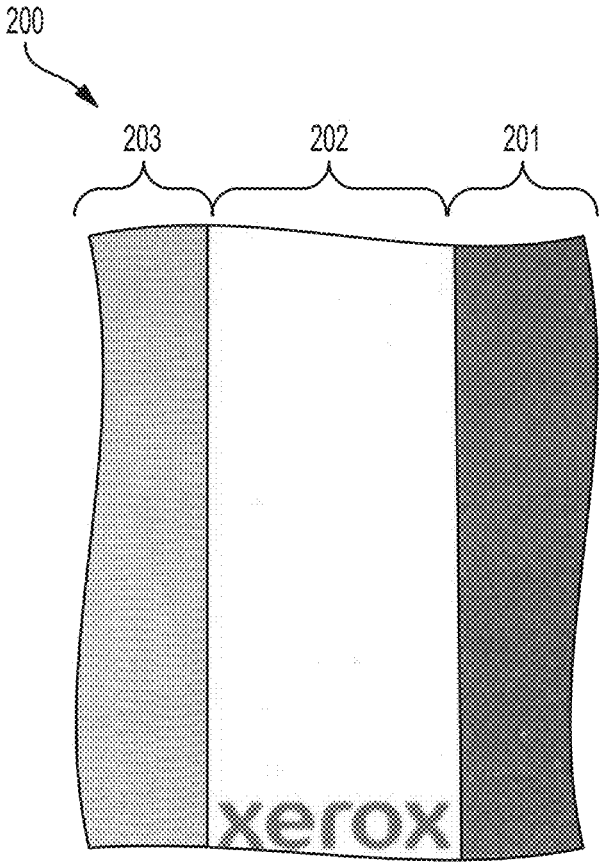
FIG. 2 shows an exemplary pattern for printing a test image using a DALI test fixture.

FIG. 2 shows an exemplary pattern used for printing a test image using the DALI test fixture described above, the test image consisting of a three 6 mm long image regions. The three image regions shown in FIG. 2 are a solid print region 201, a 50% halftone dots region 203, and a blank region (i.e. an unprinted area) with text on the edges 202 to measure background.

Figure 3:
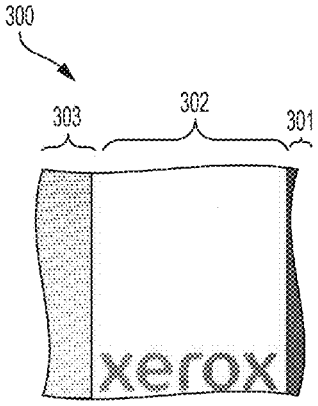
FIG. 3 shows a portion of an exemplary test image printed after 50 print cycles on a DALI test fixture.

FIG. 3 shows a portion of an exemplary test image 300 printed after 50 print cycles, using the DALI test fixture, consisting of three 6 mm long image regions: solid region 301, a 50% halftone dots region 303, and half width blank region 302, to show effects of laser wear and the ability of rejuvenating oils to repair such wear.

As printing continues on a DALI imaging member, the ability of the reimageable surface to release the ink starts to degrade. This is manifested in the print images as background ink, with appearance of small dots of ink in the blank region. Any appearance of dots of ink in the blank region of the test image is a first indicator of such a degradation.

Figure 4:
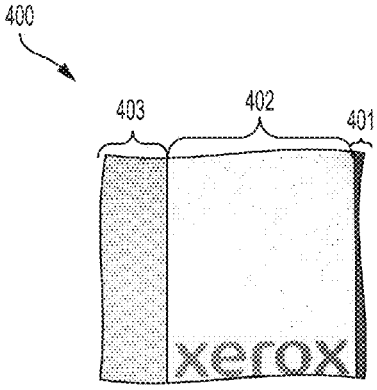
FIG. 4 shows a shows a portion of an exemplary test image printed after 500 print cycles on a DALI test fixture.

FIG. 4 shows a portion of another exemplary test image printed after 500 print cycles on the imaging member of a DALI test fixture. The test image 400 consists of three 6 mm long image regions: solid region 401, a 50% halftone dots region 403, and blank region 402. It should be noted that a small number of small dots of ink are present in the blank region 402.

Figure 5:
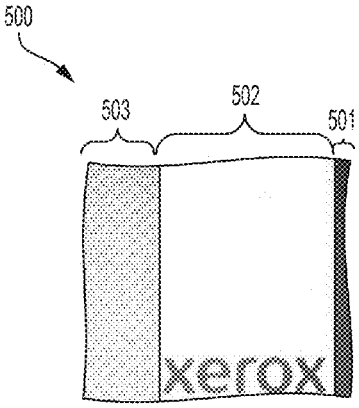
FIG. 5 shows a portion of an exemplary test image printed after 1000 print cycles which were followed by rejuvenation of the imaging member of a DALI test fixture.

FIG. 5 shows a portion of another exemplary test image printed after 1000 print cycles which were followed by rejuvenation of the imaging member of a DALI test fixture with a rejuvenating oil comprising pendant propylamine PDMS. The test image 500 consists of three 6 mm long image regions: solid region 501, a 50% halftone dots region 503, and blank region 502. It should be noted that after rejuvenation, the blank region 502 does not have any background dots of ink and is of the same quality if not better as the exemplary test image 300 shown in FIG. 3, at 50 printing cycle.

The optical densitometer values of the blank regions of FIGS. 3-5 are summarized in the Table 3 below:

TABLE 3

| | Before Rejuvenation | | | After rejuvenation |
|---|---|---|---|---|
| # of Print Cycles | 50 | 500 | 1000 | 1100 |
| Optical Densitometer (OD) value | .02 | .08 | 0.11 | .03 |

Table 3 clearly shows that an application of an oil comprising pendant propylamine PDMS on the reimageable surface of the DALI imaging member of a DALI test fixture or a printer results in the rejuvenation of the reimageable surface layer of the DALI imaging member, like almost new.

The present disclosure has been described with reference to exemplary embodiments. Although a few embodiments have been shown and described, it will be appreciated by those skilled in the art that changes may be made in these embodiments without departing from the principles and spirit of preceding detailed description. It is intended that the present disclosure be construed as including all such modifications and alterations insofar as they come within the scope of the appended claims or the equivalents thereof.

The invention claimed is:

1. A method for an ink-based digital printing system, comprising:

i. providing an imaging member comprising:

a. a reimageable surface layer disposed on a structural mounting layer, the reimageable surface layer comprising a fluorosilicone elastomer and an infrared-absorbing filler comprising carbon black, and b. a plurality of surface defects on the reimageable surface layer, wherein the surface defects comprises carbon black exposed through the fluorosilicone elastomer; and ii. applying a coating of rejuvenating oil comprising an amino-functional organopolysiloxane to the reimageable surface layer, whereby at least a portion of the plurality of surface defects are coated by the amino-functional organopolysiloxane, thereby rejuvenating the imaging member, wherein the coating of rejuvenating oil is applied in an amount of less than 0.05 grams per square meter.

2. The method of claim 1, wherein the amino-functional organopolysiloxane has the following Formula:

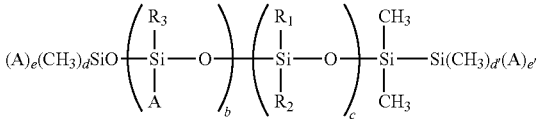

wherein i. A represents —$R_4$—X;

ii. X represents —$NH_2$ or —$NHR_5NH_2$;

iii. $R_4$ and $R_5$ are the same or different and each is an alkyl having from 1 to 10 carbons;

iv. $R_1$ and $R_2$ are the same or different and each is an alkyl having from 1 to 25 carbons, an aryl having from 4 to 10 carbons, or an arylalkyl;

v. $R_3$ is an alkyl having from 1 to 25 carbons, an aryl having from about 4 to about 10 carbons, an arylalkyl, or a substituted diorganosiloxane chain having from 1 to 500 siloxane units;

vi. b and c are numbers and are the same or different and each satisfy the conditions of $0 \leq b \leq 10$ and $10 \leq c \leq 1{,}000$; and vii. d and d' are numbers and are the same or different and are 2 or 3, and e and e' are numbers and are the same or different and are 0 or 1 and satisfy the conditions that d+e=3 and d'+e'=3; and viii. b, e, and e' must not all be 0 at the same time.

3. The method of claim 1, wherein the amino-functional organopolysiloxane comprises an amino-functional group present in an amount of from 0.01 to 0.7 mol % amine.

4. The method of claim 1, wherein the amino-functional organopolysiloxane comprises an alpha amino, an alpha-omega diamino, a pendant D-amino, a pendant D-diamino, a pendant T-amino or a pendant T-diamino group.

5. The method of claim 1, wherein the rejuvenating oil is a blend of two or more amino-functional organopolysiloxanes.

6. The method of claim 1, wherein the rejuvenating oil is a blend of the amino-functional organopolysiloxane and a non-functional silicone oil.

7. The method of claim 1, wherein the fluorosilicone elastomer is a crosslinked fluorosilicone elastomer formed by a platinum-catalyzed crosslinking reaction between a vinyl-functional fluorosilicone and at least one of a hydride-functional silicone or a hydride-functional fluorosilicone, and wherein the infrared-absorbing filler comprising carbon black is dispersed throughout the vinyl-functional fluorosilicone before the crosslinking reaction.

8. The method of claim 1, wherein the infrared-absorbing filler further comprises one or more of a metal oxide, carbon nanotubes, graphene, graphite, and carbon fibers.

* * * * *